US009208706B1

(12) United States Patent
Baron

(10) Patent No.: US 9,208,706 B1
(45) Date of Patent: Dec. 8, 2015

(54) MODULAR LAWN SIGN AND ITS ASSOCIATED METHOD OF ASSEMBLY

(71) Applicant: Steven Baron, Mississaugia (CA)

(72) Inventor: Steven Baron, Mississaugia (CA)

( * ) Notice: Subject to any disclaimer, the term of this patent is extended or adjusted under 35 U.S.C. 154(b) by 0 days.

(21) Appl. No.: 14/221,849

(22) Filed: Mar. 21, 2014

(51) Int. Cl.
*G09F 15/00* (2006.01)

(52) U.S. Cl.
CPC ..... *G09F 15/0075* (2013.01); *G09F 15/0037* (2013.01)

(58) Field of Classification Search
USPC ..... 40/607.01, 607.03, 607.04, 607.05, 40/607.06, 645
See application file for complete search history.

(56) References Cited

U.S. PATENT DOCUMENTS 2,022,160 A * 11/1935 Sorensen et al. ..... 40/612
2,207,180 A * 7/1940 Smith et al. ..... 40/645
2,939,236 A * 6/1960 Stein ..... 40/311
4,357,772 A * 11/1982 Amick et al. ..... 40/605
4,685,233 A * 8/1987 Hull ..... 40/607.02
5,502,910 A 4/1996 Lucchesi
5,921,011 A * 7/1999 Hawver ..... G09F 3/12 248/174
6,397,451 B1 6/2002 Gill

* cited by examiner

*Primary Examiner* — Joanne Silbermann
(74) *Attorney, Agent, or Firm* — LaMorte & Associates, P.C.

(57) ABSTRACT

A prefabricated sign assembly that is self-supporting once set in the ground. The sign assembly has a base post. The base post has a bottom ground spike and a top free end. An extender post is provided. The extender post slides over the top of the base post. An internal support post is provided. The bottom of the internal support post slides over the top of the extender post. A sign board is provided having a first face panel and a second face panel. The two face panels are joined at a spine panel. A polygonal hole is disposed through the spine panel. The internal support post extends through the hole, wherein the internal support post and the hole rotationally interlock. The first face panel and the second face panel of the sign board are folded against the internal support post and are secured with fasteners.

10 Claims, 5 Drawing Sheets

MODULAR LAWN SIGN AND ITS ASSOCIATED METHOD OF ASSEMBLY

BACKGROUND OF THE INVENTION

1. Field of the Invention

In general, the present invention relates to the structure of temporary lawn signs with support posts that are driven into the ground. More particularly, the present invention relates to the structure of signs and how the signage connects to the support post.

2. Prior Art Description

There are many instances when a person or company may want to set up a temporary sign for the public to view. For instance, temporary signs are often set up to promote garage sales, car washes, and election candidates. Such signs are typically intended to last from a day to a couple of weeks before the sign is removed. Also, such signs are usually printed on water resistant material so they can withstand a few days of inclement weather. Furthermore, such signs are traditionally mounted to a wooden stake or a thin wire frame to minimize the overall cost of the sign assembly.

Although such sign assemblies work well for garage sales and elections, the sign assemblies have certain inherent problems that prevent the sign assemblies from being used for other purposes. One of the inherent disadvantages is that such prior art sign assemblies must be posted close to the ground. The insubstantiality of the sign assembly's support cannot prevent tall signs from tipping, especially if strong winds occur. An associated second disadvantage is that the insubstantiality of the support requires that the sign being displayed be both lightweight and small so as to minimize the forces experienced by the support. Such prior art sign systems are exemplified by U.S. Pat. No. 6,397,451 to Gill, entitled Signage Manufacturing Method.

It is partially for these reasons, that when a person wants to temporarily display a larger, more prominent sign, election-type sign assemblies are not preferred. Entities such as realtors and small businesses often display temporary signs of significant size. However, these entities often want the signs to be supported well above ground level, so that the signs can be more readily seen by passing motorists. As such, the signs are often affixed to custom-built posts that are anchored into holes dug into the ground. Such signs are heavy, difficult to move, difficult to install, and are expensive. In the prior art, prefabricated sign systems have been developed. However, these sign systems are also complex and expensive. Such prior art sign systems commonly contain a separate anchor post that must be driven into the ground before the signpost can be erected. Great labor is needed to remove the anchor post from the ground after the sign is removed. Such prior art sign systems are exemplified by U.S. Pat. No. 5,502,910 to Lucchesi, entitled Real Estate Sign Pole.

A need therefore exists for a strong, sturdy and low cost sign system that is prefabricated and can support a large sign at an elevated height. A need also exists for such a sign system that is easy to erect and easy to remove. Theses needs are met by the present invention as described and claimed below.

SUMMARY OF THE INVENTION

The present invention is a prefabricated temporary sign assembly that is self-supporting once set in the ground. The sign assembly has a base post. The base post has a bottom end that is shaped as a ground spike and a top free end. An extender post is provided having a top first end, a bottom second end and a first internal stop. The second end of the extender post slides over the top first end of the base post until the base post contacts the first internal stop.

An internal support post is provided having a top first end, a bottom second end and a second internal stop. The bottom second end of the internal support post slides over the top first end of the extender post until the extender post contacts the second internal stop.

A sign board is provided having a first face panel and a second face panel. The two face panels are joined at a spine panel. A polygonal hole is disposed through the spine panel. The internal support post extends through the hole, wherein the internal support post and the hole rotationally interlock. The first face panel and the second face panel of the sign board are folded against the internal support post. Mechanical fasteners are then used to join the first face panel and the second face panel directly to the internal support post.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention modular sign assembly can be embodied to hold signs of various sizes at various heights, the exemplary embodiment illustrated only shows one primary embodiment and a secondary embodiment that contains only a slight variation. These embodiments are selected in order to set forth some of the best modes contemplated for the invention. The illustrated embodiments, however, are merely exemplary and should not be considered limitations when interpreting the scope of the appended claims.

Figure 1:
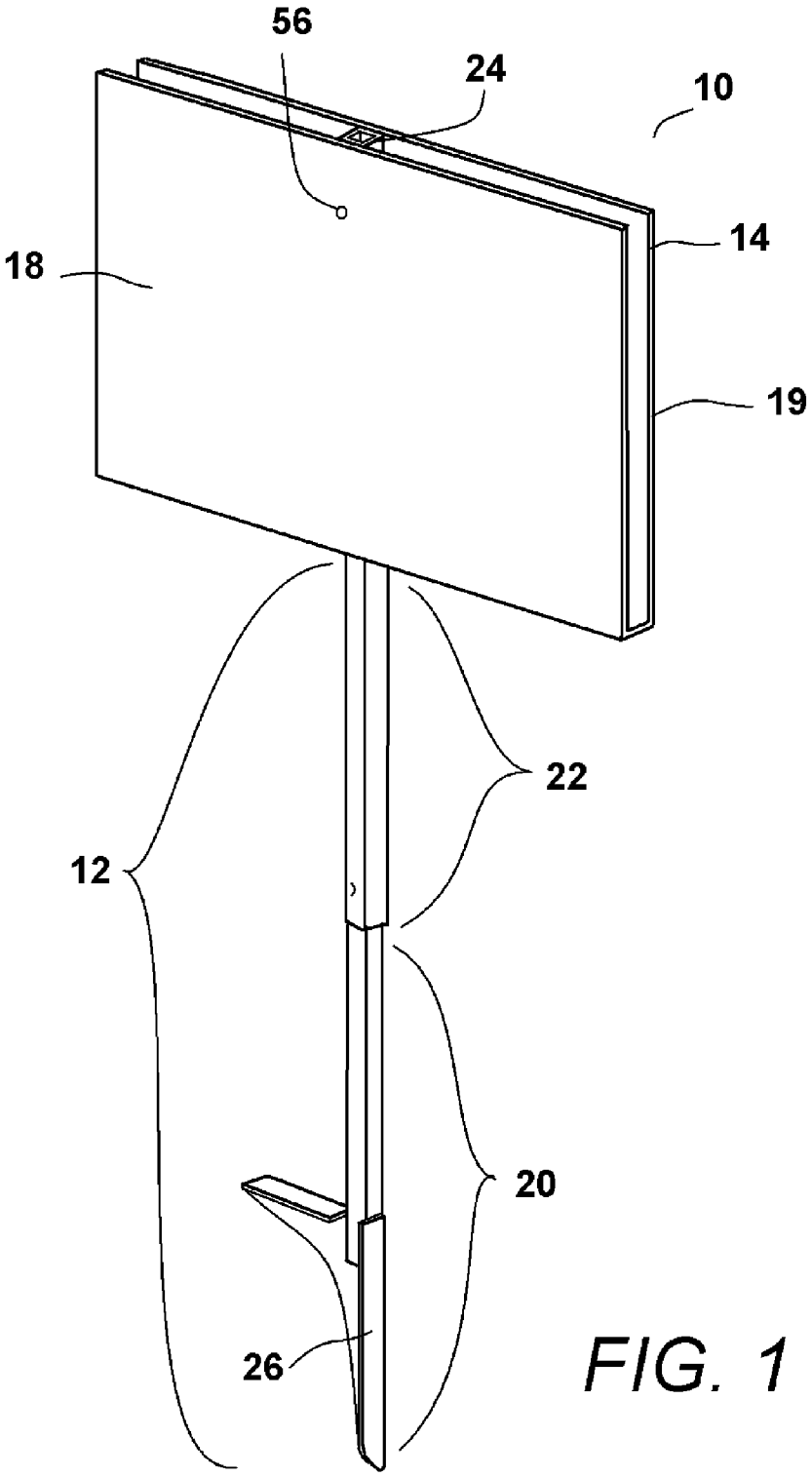
FIG. 1 is a perspective view of an exemplary embodiment of a modular sign assembly in accordance with the present invention.
Figure 2:
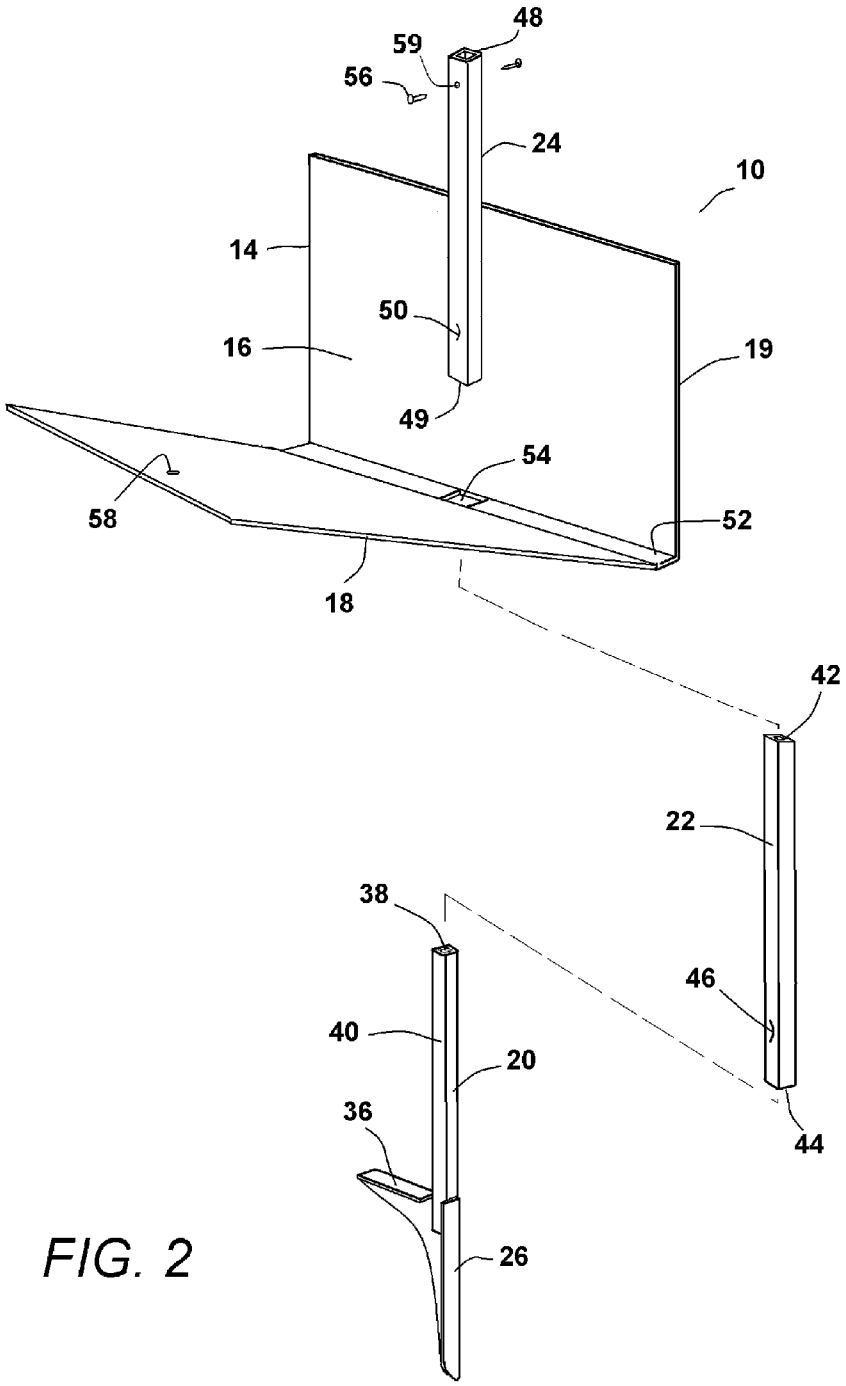
FIG. 2 is an exploded view of the embodiment of FIG. 1.
Figure 3:
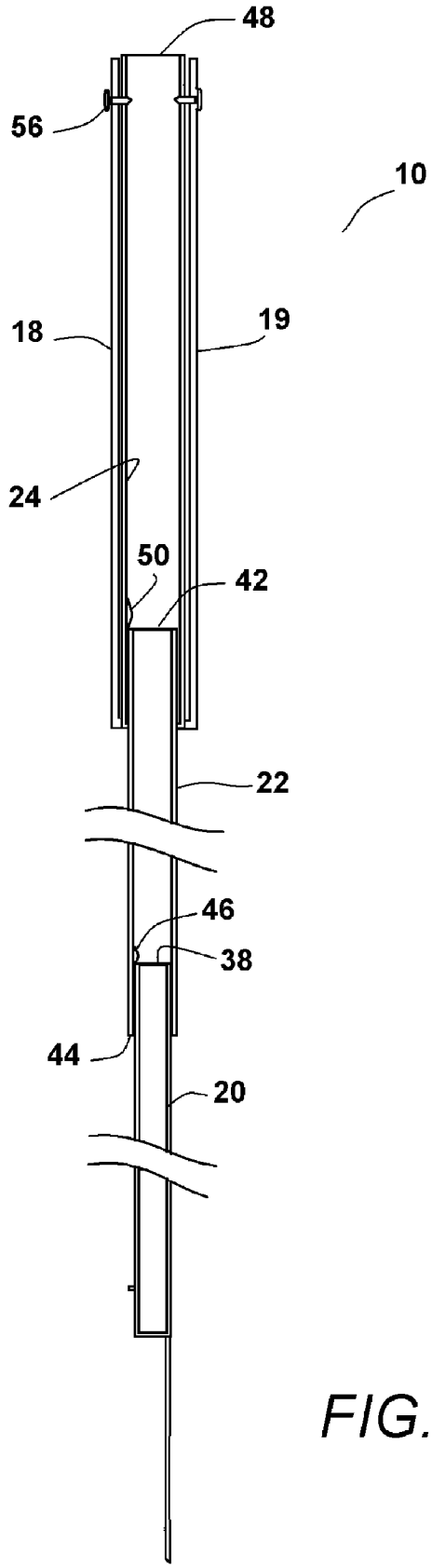
FIG. 3 a cross-sectional view of the embodiment of FIG. 1.

Referring to FIG. 1 in conjunction with FIG. 2 and FIG. 3, a modular sign assembly 10 is illustrated. The modular sign assembly 10 includes a support post assemblage 12 that is intended to support a sign 14. The sign 14 is made from a folded sign board 16, which provides the sign with two face panels 18, 19. Both face panels 18, 19 are unobstructed by the support post assemblage 12.

Figure 4:
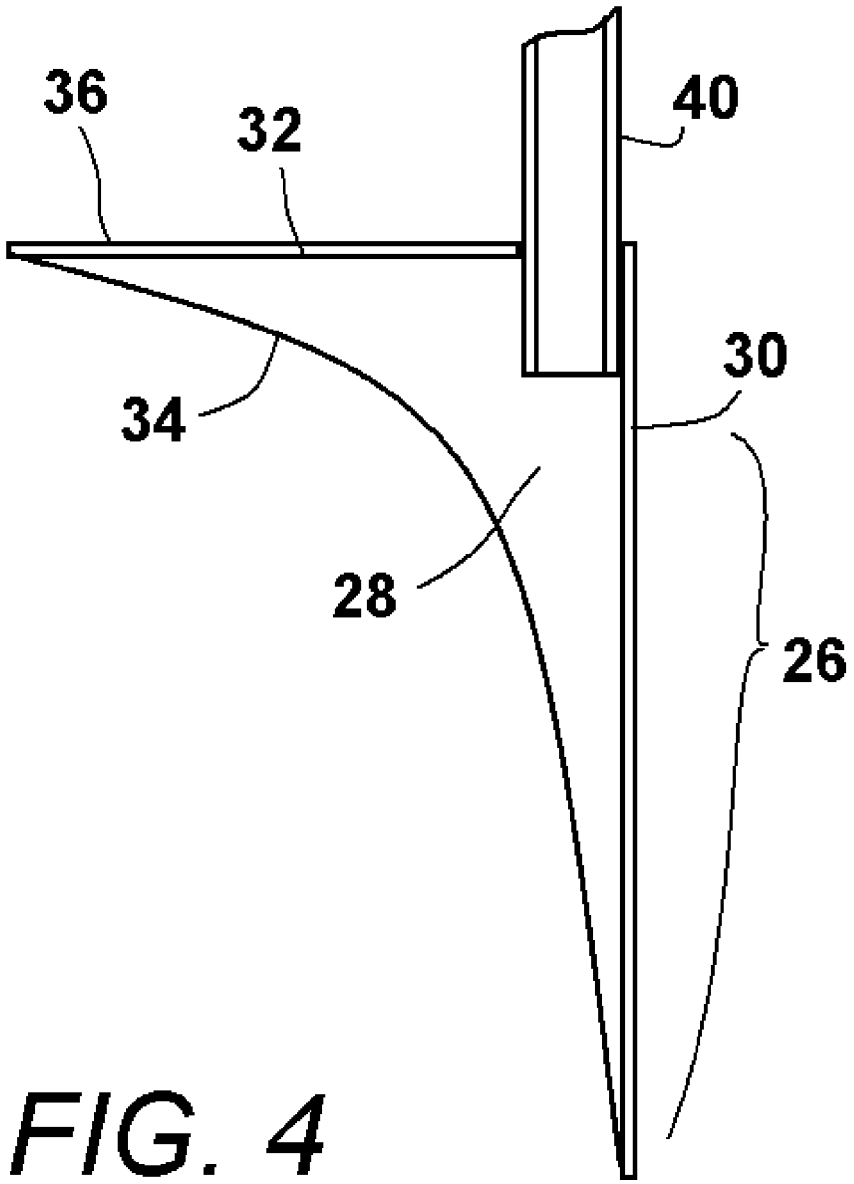
FIG. 4 is an enlarged view of the second end of the support post used in the exemplary modular sign assembly.

The support post assemblage 12 is modular in its construction and contains three primary parts. The three primary parts include a base post 20, an extender post 22, and an internal support post 24. Referring to FIG. 4, it can be seen that the base post 20 contains a simple, inexpensive ground spike 26. The ground spike 26 is made from a sheet of steel 28 that is cut into the general shape of a right triangle. As such, the sheet of steel 28 has an adjacent side 30, an opposite side 32 and a hypotenuse 34. The sheet of steel 28 along the adjacent side 30 and the opposite side 32 are bent at right angles. This provides rigidity to the ground spike 26. Furthermore, the bend along the opposite side 32 of the ground spike 26 creates a flat lateral surface 36. The flat lateral surface 36 provides the structure needed for a person to press the ground spike 26 into the ground with his/her foot. A vertical tube 40 is welded or otherwise affixed to the ground spike 26. The vertical tube 40 extends vertically above the flat lateral surface 36 of the ground spike 26, wherein the flat lateral surface 36 lays normal to the vertical tube 40. The vertical tube 40 terminates with a free end 38 that is a length L1 away from the flat lateral surface 36. The length L1 has a preferred range of between six inches and six feet. In the illustrated embodiment, the vertical tube 40 has a square cross-sectional profile. It will be understood that other polygonal cross-sectional shapes can be used and the use of a square tube is merely exemplary.

Returning to FIGS. 1, 2, and 3, it can be seen that the extender post 22 of the support post assemblage 12 is comprised of a segment of tubing. The extender post 22 has a top first end 42, a bottom second end 44 and a length L2 that extends between the first end 42 and the second end 44. The extender post 22 has an internal cross sectional shape that is the same polygonal shape and just slightly larger than the exterior of the vertical tube 40. In this manner, the free end 38 of the vertical tube 40 can pass into the second end 44 of the extender post 22. However, the vertical tube 40 and the extender post 22 cannot rotate independently once interconnected, due to their polygonal cross-sectional shapes.

A first stop indentation 46 is formed in the extender post 22 a few inches from its second end 44. The first stop indentation 46 provides a physical barrier that prevents the vertical tube 40 from passing completely through the extender post 22. Consequently, although the vertical tube 40 can pass into the extender post 22, it can only pass a few inches into the extender post 22 before it is stopped by the presence of the first stop indentation 46. The extender post 22 is linearly aligned with the vertical tube 40 when interconnected with the vertical tube 40. The length L2 of the extender post 22 can vary from six inches to three feet. As such, it will be understood that extender posts 22 of different lengths can be used to support signs at different heights.

The internal support post 24 of the support post assemblage 12 is comprised of a segment of tubing. The internal support post 24 has a top first end 48, a bottom second end 49 and a length L3 that extends between the first end 48 and the second end 49. The length L2 shown is the same height as the two face panels 18, 19 of the sign board 16 that is being displayed. However, the length L2 of the internal support post 24 can be longer than the two face panels 18, 19 so that the internal support post 24 will protrude above the sign board 16.

The internal support post 24 has an internal cross sectional shape that is the same polygonal shape and just slightly larger than the exterior of the extender post 22. In this manner, the first end 42 of the extender post 22 can pass into the second end 49 of the internal support post 24. However, the internal support post 24 and the extender post 22 cannot rotate independently once interconnected.

A second stop indentation 50 is formed in the internal support post 24 a few inches from its second end 49. The second stop indentation 50 provides a physical barrier that prevents the extender post 22 from passing completely into the internal support post 24. Consequently, although the extender post 22 can pass into the internal support post 24, the extender post 22 can only pass a few inches into the internal support post 24 before it is stopped by the presence of the second stop indentation 50. The internal support post 24 is linearly aligned with the extender post 22 when interconnected with the extender post 22.

The sign 14 is preferably made of waterproof material, such as corrugated polypropylene. The sign 14 is fabricated as a single sign board 16 that is folded to create the two parallel sign face panels 18, 19 of the sign 14. The face panels 18, 19 of the sign board 16 are printed with any graphic and/or text desired. Two parallel folds are formed in the sign board 16. The two folds divide the sign board 16 into three sections. The three sections include the two face panels 18, 19 and a spine panel 52 that is interposed between the two face panels 18, 19. The width of the spine panel 52 is equal to the exterior width of the internal support post 24.

A polygonal hole 54 is cut through the sign board 16 in the center of the spine panel 52. The hole 54 is the same polygonal shape and only slightly larger than the exterior of the second end 49 of the internal support post 24. The internal support post 24 is advanced through the hole 54. The two face panels 18, 19 of the sign board 16 are then folded up against the internal support post 24 so that the internal support post 24 is interposed between the parallel face panels 18, 19 of the signage. The second end 49 of the internal support post 24 extends through the hole 54. Due to the matching polygonal shapes, the internal support post 24 cannot rotate within the hole 54. This rotationally interlocks the sign board 16 to the internal support post 24. The interconnection also prevents the spine panel 52 of the sign board 16 from separating from the internal support post 24.

The sign board 16 used to create the sign 14 is folded flush against the internal support post 24. Mechanical fasteners 56 are used to connect the sheet of material to the internal support post 24 near the tops of the face panels 18, 19. Pilot holes 58, 59 for the mechanical fasteners 56 can be prefabricated within the face panels 18, 19 and the internal support post 24, respectively.

In order to assemble the modular sign assembly 10, the desired graphic and/or text is molded onto the face panels 18, 19 of the sign board 16. The sign board 16 is folded and the internal support post 24 is inserted through the hole 54 in the spine panel 52. The face panels 18, 19 of the sign board 16 are then folded against the internal support post 24 and are locked to the internal support post 24 using the mechanical fasteners 56. The ground spike 26 is driven into the ground by stepping upon the flat lateral surface 36. Once set into the ground, the extender post 22 is set over the base post 20. The internal support post 24 with the sign 14 it supports is then set over the extender post 22 to complete the sign assembly 10.

Since only the base post 20 is driven into the ground, the extender post 22 and the internal support post 24 can be made from thinner gauges of metal than is the base post 20. Alternatively, the extender post 22 and/or the internal support post 24 can be fabricated from plastic. The extender post 22 and the internal support post 24 are not utilized when the base post 20 is pounded into the ground. Therefore, they do not need to be strong enough to transfer impact forces. Rather, the internal support post 24 and the extender post 22 need only be strong enough to support the weight of the sign board 16 and any forces that wind and weather may apply to that sign board 16.

Figure 5:
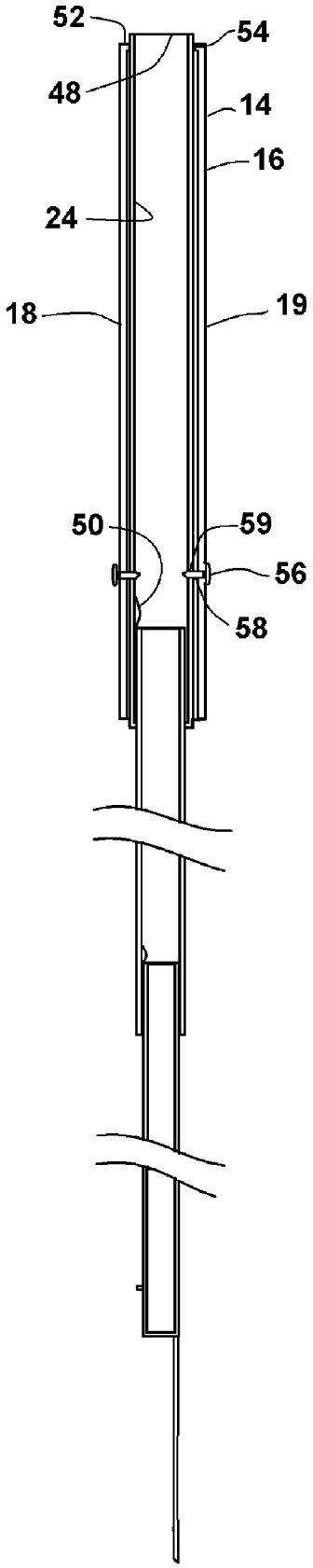
FIG. 5 is a cross-sectional view of an alternate embodiment wherein the sign board is inverted.

In the embodiment of FIGS. 1, 2 and 3, the sign board 16 is folded and attached to the internal support post 24 so that the spine panel 52 is located at the bottom of the sign 14. If, due to climatic conditions, it is desirable to have the top of the sign 14 protected, the position of the sign 14 can be inverted. Referring to FIG. 5, it can be seen that the spine panel 52 of the sign 14 can be positioned at the top first end 48 of the internal support post 24, wherein the first end 48 of the internal support post 24 passes into the hole 54 in the spine panel 52. The face panels 18, 19 of the sign board 16 are then folded down along the sides of the internal support post 24. The face panels 18, 19 of the signage are then attached to the internal support post 24 using the mechanical fasteners 56. The pilot holes 58, 59 for the mechanical fasteners 56 are preferably located above the second stop indentation 50 within the internal support post 24. In this manner, the mechanical fasteners 56 do not interfere with the interconnection between the extender post 22 and the internal support post 24.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A sign assembly, comprising:

a base post, having a first end and a second end, wherein said second end is shaped as a ground spike;

an extender post having a first end, a second end and a first internal stop, wherein said second end of said extender post slides over said first end of said base post until said base post contacts said first internal stop;

an internal support post having a first end, a second end, a second internal stop, and a polygonal cross-sectional shape, wherein said second end of said internal support post slides over said first end of said extender post until said extender post contacts said second internal stop;

a sign board having only two parallel folds that divide said sign board into only three panels, which include a first face panel, a second face panel, and a spine panel that is interposed between said first face panel and said second face panel;

fastener holes disposed through said first face panel and said second face panel;

a post hole disposed through said spine panel, said post hole having a polygonal shape;

wherein said internal support post extends through said post hole and both said first face panel and said second face panel are folded against said internal support post; and mechanical fasteners that extend through said fastener holes and join said first face panel and said second face panel directly to said internal support post.

2. The assembly according to claim 1, wherein said post hole engages said internal support post and prevents said sign board from rotating about said internal support post.

3. The assembly according to claim 1, wherein said first end of said base post has a polygonal cross-sectional profile that prevents said extender post from rotating upon said first end of said base post.

4. The assembly according to claim 3, wherein said first end of said extender post has a polygonal cross-section that prevents said internal support post from rotating upon said first end of said extender post.

5. The assembly according to claim 1, wherein said first end of said internal support post extends to an elevation at least as high as said sign board so as to be exposed atop said assembly.

6. The assembly according to claim 1, further including a foot platform extending laterally from said base post.

7. The assembly according to claim 6, wherein said base post includes a vertical tube affixed to a triangular plate, wherein said triangular plate forms said ground spike and said foot platform.

8. The assembly according to claim 7, wherein said triangular plate is a right triangle having an adjacent side, an opposite side and a hypotenuse, wherein said adjacent side is linearly aligned with said vertical tube.

9. The assembly according to claim 8, wherein said triangular plate contains right angle bends along said adjacent side and said opposite side that provide rigidity to said triangular plate.

10. The assembly according to claim 7, wherein said vertical tube, said extender post, and said internal support post are linearly aligned.

* * * * *